US006301725B1

(12) United States Patent
Harvey

(10) Patent No.: US 6,301,725 B1
(45) **Date of Patent: *Oct. 16, 2001**

(54) CORNER SHOWER SEAT

(76) Inventor: Brian Harvey, 17490 Meandering Way #106, Dallas, TX (US) 75252

( * ) Notice: Subject to any disclaimer, the term of this patent is extended or adjusted under 35 U.S.C. 154(b) by 0 days.

This patent is subject to a terminal disclaimer.

(21) Appl. No.: 09/645,820

(22) Filed: Aug. 24, 2000

Related U.S. Application Data

(63) Continuation-in-part of application No. 09/353,970, filed on Jul. 15, 1999, which is a continuation-in-part of application No. 09/226,385, filed on Jan. 6, 1999, now Pat. No. 6,052,845.

(51) Int. Cl.[7] ..... A47K 3/12

(52) U.S. Cl. ..... 4/611; 4/612; 4/614; 52/36.4; 52/344

(58) Field of Search ..... 4/559, 571.1, 573.1, 4/578.1, 605, 611, 612, 614; 248/220.1; 52/36.4, 344, 385, 389, 390; 108/42; 211/119.009

(56) References Cited

U.S. PATENT DOCUMENTS

| | | | | |
|---|---|---|---|---|
| D. 360,023 | | 7/1995 | Hunger et al. | D23/304 |
| D. 395,135 | | 6/1998 | Joss | D23/304 |
| 1,876,828 | * | 9/1932 | Ashfield | 52/36.4 |
| 2,859,606 | * | 11/1958 | Scardino | 52/36.4 |
| 4,708,310 | | 11/1987 | Smith | 248/220.1 |
| 5,340,070 | | 8/1994 | Soma | 248/220.1 |
| 5,542,218 | | 8/1996 | Rompel | 52/34 |
| 5,732,421 | | 3/1998 | Scherberger | 4/611 |
| 6,052,845 | * | 4/2000 | Harvey | 4/611 |

OTHER PUBLICATIONS

Brian Harvey, "Affidavit Under 37 C.F.R. 1.131", 2 pgs, Sep. 12, 2000.*

* cited by examiner

*Primary Examiner*—Robert M. Fetsuga
(74) *Attorney, Agent, or Firm*—Smith, Danamraj & Youst, P.C.

(57) ABSTRACT

A shower seat for installation within a corner of a shower stall. The shower seat may be constructed from a wide variety of rigid materials and is polygonal in shape. A horizontal corner strip of backboard of shower walls within the shower stall is removed to form a slot. A back portion of the shower seat is inserted into the slot such that the edges are against vertical wall studs supporting the backboard of the shower walls.

5 Claims, 3 Drawing Sheets

CORNER SHOWER SEAT

RELATED APPLICATIONS

This application is a continuation-in-part of co-pending U.S. patent application Ser. No. 09/353,970 filed Jul. 15, 1999 in the names of Brian Harvey and Mark Horton, which is a continuation in part of U.S. patent application Ser. No. 09/226,385 filed Jan. 6, 1999 and now U.S. Pat. No. 6,052,845, which is hereby incorporated in its entirety by reference herein.

BACKGROUND OF THE INVENTION

1. Technical Field of the Invention

This invention relates to seats and shelves used in bathrooms, and more particularly, to a horizontal seat installed in a shower stall.

2. Description of Related Art

Shower seats are well known fixtures in many showers. Shower seats assist many people. For example, many disabled people find it necessary to sit while showering. However, although the use of shower seats is known, there are many problems associated with the installation of these seats in an existing shower stall. The shower seat must be permanently attached within a shower stall, allowing enough support for an adult to place his or her full weight on the shower seat.

U.S. Ser. No. 09/226,385 describes a marble shower seat installed within a shower stall. However, the installation of the disclosed shower seat is limited to a horizontal marble slab. A shower seat is needed which provides a secure shower seat which can be constructed from a variety of different materials.

It would be a distinct advantage to have a shower seat which can be constructed of a wide variety of materials. It is an object of the present invention to provide such a device.

SUMMARY OF THE INVENTION

In one aspect, the present invention is a shower stall seat assembly. The shower stall seat assembly includes a horizontal slab constructed of a rigid material and a shower stall having vertical wall studs attached to a backboard where a corner strip of backboard has been removed to form a corner slot at approximately the desired height for the shower seat. The seat assembly also includes a first section of exterior wall material attached to the backboard such that a top portion of the first section of exterior wall material is at the bottom level of the corner slot. A portion of the slab is inserted into the corner slot such that edges of the slab are against the vertical wall studs and the slab rests on the first section of exterior wall material and the backboard. The shower stall seat assembly also includes a second section of exterior wall material attached to the backboard around and on top of the slab and grouted in place.

In another aspect, the present invention is a shower seat assembly. The shower seat assembly includes a horizontal rigid slab and a shower stall having a plurality of vertical wall studs attached to a backboard of the shower stall. A horizontal corner strip of backboard is removed to form a corner slot, whereby a back portion of the slab is inserted into the corner slot such that edges of the slab are against the vertical wall studs. The shower seat assembly also includes a first section of exterior wall material attached to the backboard adjacent a top side of the slab and a second section of exterior wall material attached to the backboard adjacent a bottom side of the slab. The slab rests on the second section of exterior wall material adjacent the top side and the bottom side of the slab and the backboard.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

A corner shower seat constructed of a rigid material in a shower stall is disclosed.

Figure 1:
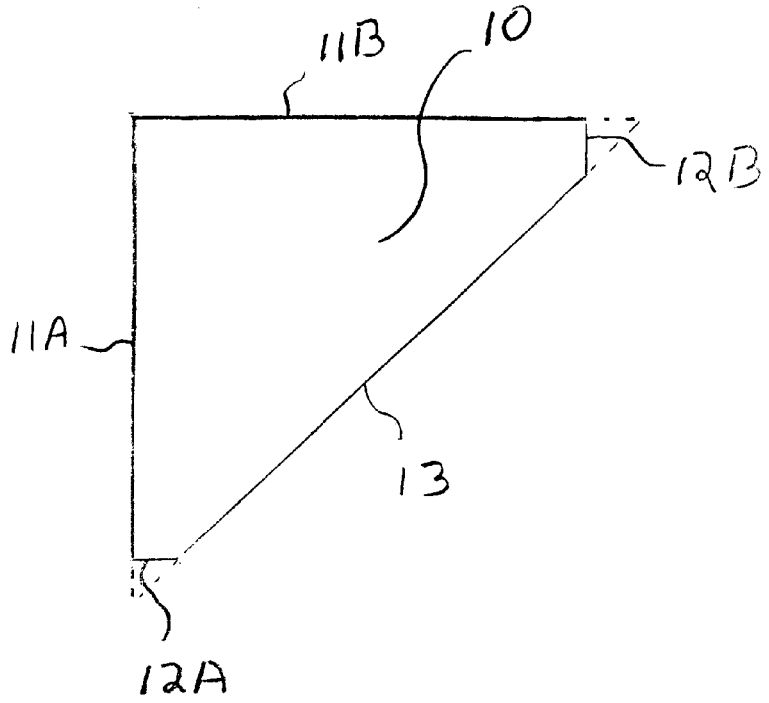
FIG. 1 is a top plan view of a horizontal slab in the preferred embodiment of the present invention.

FIG. 1 is a top plan view of a horizontal slab 10 in the preferred embodiment of the present invention. Preferably, the shower seat is polygonal in shape and constructed of cultured marble having a thickness of at least ¾ of an inch. However, the horizontal slab may be made of any rigid material able to hold the weight of a person, such as natural stone, plastic, concrete, fiberglass, or any ceramic. In the preferred embodiment, the slab 10 includes edges 11A, 11B, 12A, 12B, and 13.

Figure 2:
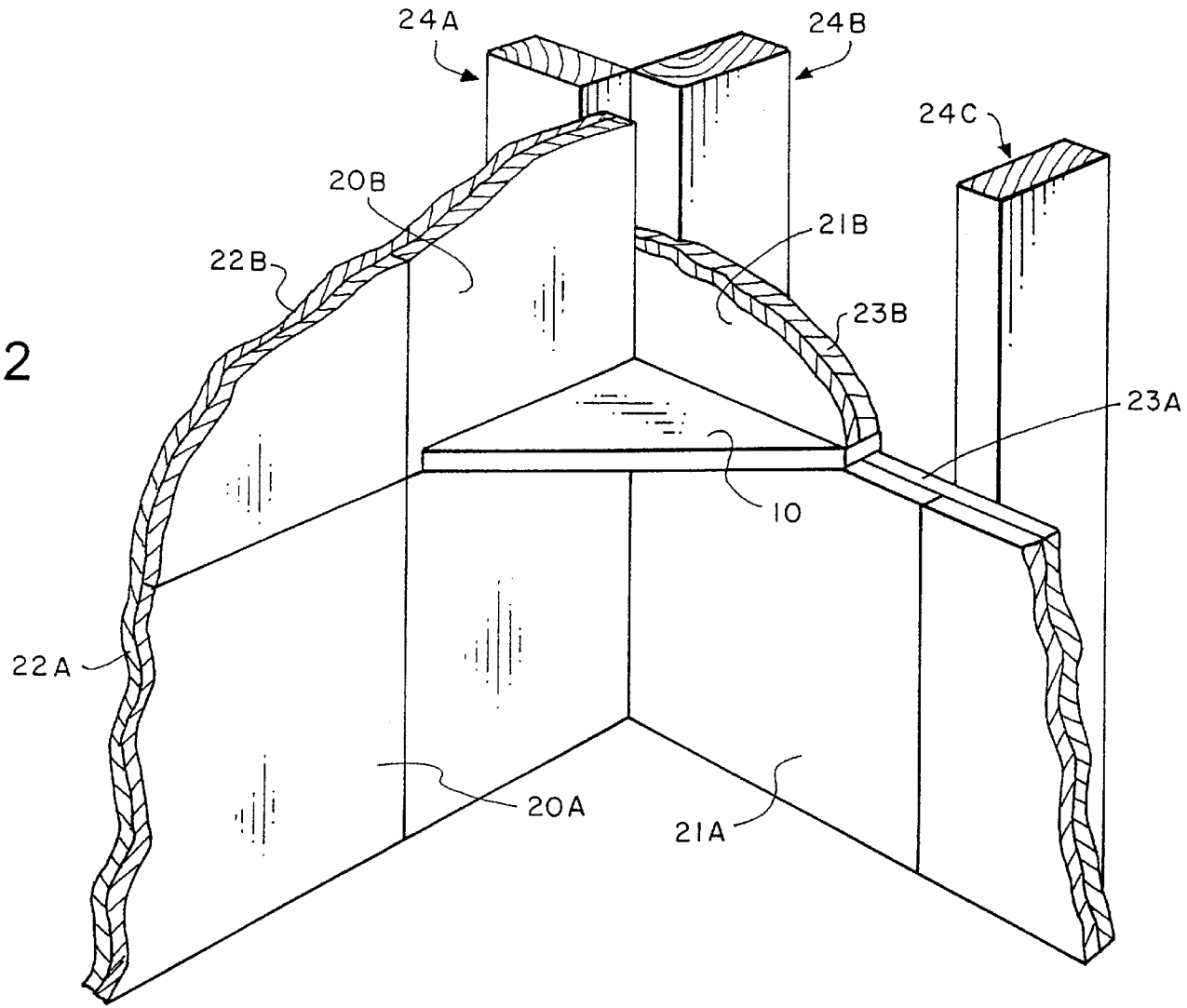
FIG. 2 illustrates the slab of FIG. 1 installed within a corner of a shower stall in the preferred embodiment of the present invention.

FIG. 2 illustrates the slab 10 of FIG. 1 installed within a corner of a shower stall in the preferred embodiment of the present invention. Exterior wall material 20A, 20B, 21A, and 21B are constructed of a waterproof material such as marble, ceramic tile, natural stone, fiberglass, plastic, or granite. Directly behind and in contact with the exterior wall material is backboard material 22A, 22B, 23A, and 23B.

The backboard material may be constructed of plaster board, concrete board, or some other material of suitable construction. The exterior wall material is attached to the backboard material by means of adhesive grout and cement grout materials which are well known in the art. However, any adhesive material may be used to attach the exterior wall material to the backboard material. The backboard material is attached to building materials commonly used in the construction industry, such as 2"×4" studs 24A, 24B, and 24C. The backboard material may be attached to the studs by dry wall screws (not shown). At the desired vertical location for slab 10, the backboard material is removed, creating a corner opening or slot having a vertical dimension slightly larger than the thickness of the slab 10 and a horizontal length slightly longer than edges 11A and 11B such that edges 11A and 11B can be slid into the slot. Edges 11A and 11B of the slab 10 are inserted into the slot, contacting studs 24A and 24B. Slab 10 is positioned so that the slab is approximately horizontal. The bottom surface of the slab is supported by exterior wall material 20A and 21A and backboard material 22A and 23A. The top surface of the slab is supported by backboard material 22B and 23B. Exterior wall material 20B and 21B are then placed on the top surface and side of the slab. Thus, the vertical constraints allow the slab to act in a similar manner as a cantilevered beam.

Although the slab is depicted as having five sides, the slab may be any size and shape which allow two adjacent edges of the slab to be inserted into the corner walls of the shower stall. Additionally, in an alternate embodiment, the slab is sized and positioned to function as a shelf for holding objects used in the shower, rather than as a shower seat.

Figure 3:
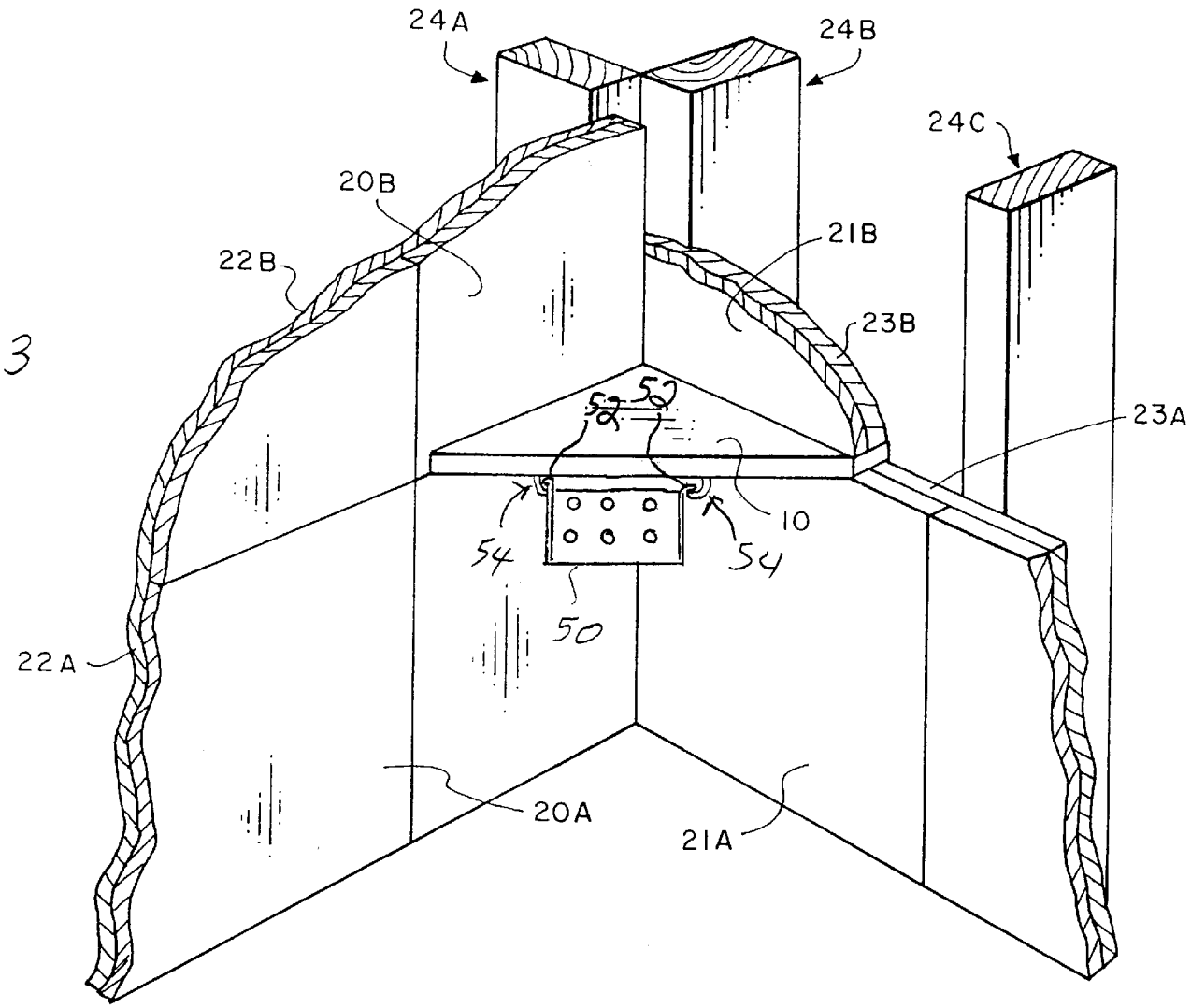
FIG. 3 illustrates the slab of FIG. 1 installed within a corner of a shower stall with a basket removably attached to an underside of the slab in the alternate embodiment of the present invention.

FIG. 3 illustrates the slab 10 of FIG. 1 installed within a corner of a shower stall with a basket 50 removably attached to an underside of the slab in the alternate embodiment of the present invention. The basket includes two overhanging edges 52 extending outwardly from an interior portion of the basket and running the length of a top portion of the basket. Each overhanging edge is located on an opposite side of the top portion of the basket. The basket may be constructed of any material which can withstand constant exposure to water, such as plastic. On the underside of the slab is railings 54 which support the overhanging edges of the basket. The basket may then be slid outwardly or inwardly as desired from the slab.

It is thus believed that the operation and construction of the present invention will be apparent from the foregoing description. While the device described has been characterized as being preferred, it will be readily apparent that various changes and modifications could be made therein without departing from the scope of the invention as defined in the following claims.

What is claimed is:

1. A shower seat assembly comprising:

a horizontal rigid slab;

a shower stall having a plurality of vertical wall studs attached to a backboard of the shower stall wherein a horizontal corner strip of backboard has been removed to form a comer slot, whereby a back portion of the slab being inserted into the corner slot such that edges of the slab are against the vertical wall studs;

a first section of exterior wall material attached to the backboard adjacent a top side of the slab; and a second section of exterior wall material attached to the backboard adjacent a bottom side of the slab, whereby the slab rests on the second section of exterior wall material adjacent the top side and the bottom side of the slab and the backboard.

2. The shower seat assembly of claim 1 wherein:

the first and second sections of exterior wall material are constructed of tile.

3. The shower seat assembly of claim 1 wherein the slab is sized and positioned to function as a shelf within the shower stall.

4. A shower stall seat assembly comprising:

a horizontal slab constructed of a rigid material;

a shower stall consisting of vertical wall studs attached to a backboard where a corner strip of backboard has been removed to form a corner slot at approximately the desired height for the shower seat;

a first section of exterior wall material attached to the backboard such that a top portion of the first section of exterior wall material is at the bottom level of said corner slot;

a portion of said slab being inserted into said corner slot such that edges of said slab are against the vertical wall studs and said slab rests on the first section of exterior wall material and the backboard; and a second section of exterior wall material attached to the backboard around and on top of said slab and grouted in place.

5. The shower stall seat assembly of claim 4 wherein:

the first and second sections of exterior wall material are constructed of tile.

* * * * *